US005495092A

United States Patent [19]

Marschke et al.

[11] Patent Number: 5,495,092

[45] Date of Patent: Feb. 27, 1996

[54] HEATING DEVICE FOR CORRUGATED PAPERBOARD PRODUCTION

[75] Inventors: Carl R. Marschke, Phillips; Larry M. Krznarich, Park Falls, both of Wis.

[73] Assignee: Marquip, Inc., Phillips, Wis.

[21] Appl. No.: 292,739

[22] Filed: Aug. 18, 1994

Related U.S. Application Data

[63] Continuation-in-part of Ser. No. 255,159, Jun. 7, 1994.

[51] Int. Cl.[6] ..... F27B 9/06

[52] U.S. Cl. ..... 219/388; 165/87; 156/470

[58] Field of Search ..... 219/385, 388, 219/390, 391, 392, 395, 401, 402; 156/359, 64, 351, 470

[56] References Cited

U.S. PATENT DOCUMENTS

| | | | |
|---|---|---|---|
| 3,175,300 | 3/1965 | Nitchie | 156/470 |
| 3,982,758 | 9/1976 | Thayer et al. | 156/64 |
| 4,479,048 | 10/1984 | Kinoshita | 219/388 |
| 5,156,714 | 10/1992 | Thomas | 156/472 |
| 5,183,525 | 2/1993 | Thomas | 156/470 |
| 5,244,518 | 9/1993 | Krayenhagen et al. | 156/64 |

*Primary Examiner*—Tu Hoang

*Attorney, Agent, or Firm*—Andrus, Sceales, Starke & Sawall

[57] ABSTRACT

A hot plate for a double racer used in the manufacture of corrugated paperboard includes a substantially all copper construction which enhances thermal conductivity and heat transfer efficiency. Steam for heating the plates is provided through an array of copper tubes extending between manifolds on opposite sides of the hot plate, all in a manner which obviates the need for heavy pressure vessel construction. The hot plate is allowed to float on its supporting frame in a manner which accommodates lateral thermal expansion, and the lateral ends are tied vertically to the supporting frame to prevent thermal bowing characteristic of prior art systems. The heating system is also applicable to a rotary preheating drum where the same benefits of thermal conductivity and heat transfer efficiency are attained. In addition, a rapid cooling system in which pressurized cooling water is supplied directly to the copper heat tubes is disclosed for use in either the double facer hot plate embodiment or the rotary preheating drum embodiment.

3 Claims, 4 Drawing Sheets

FIG. 3
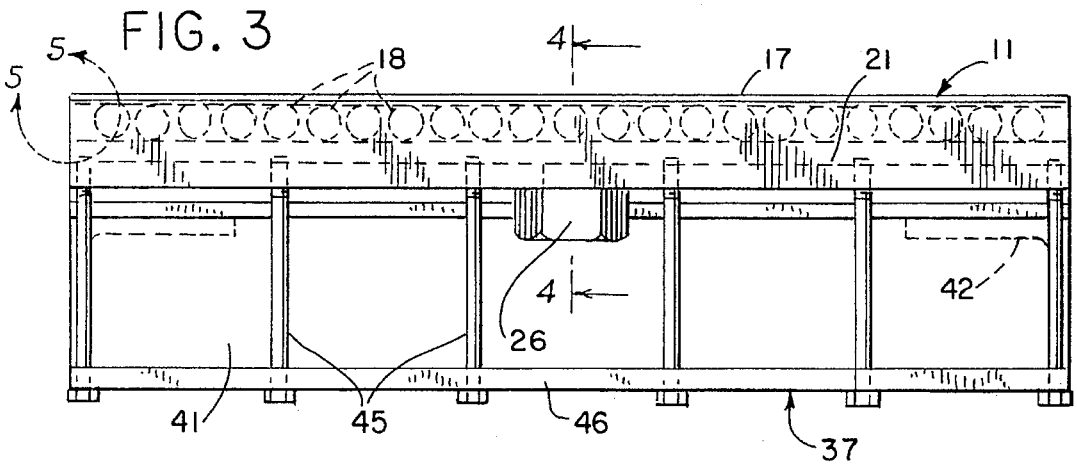
FIG. 4
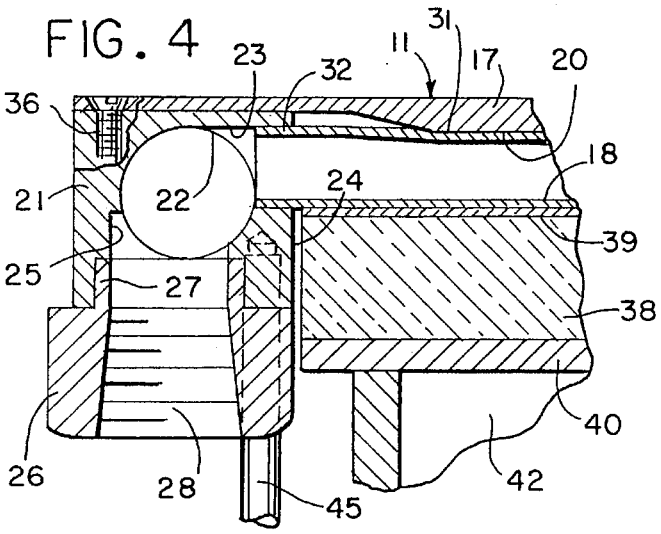
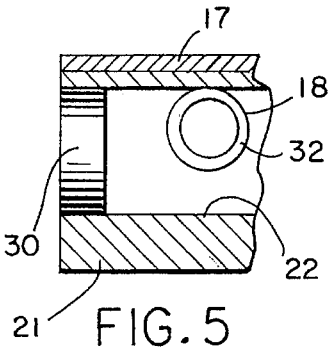
FIG. 5
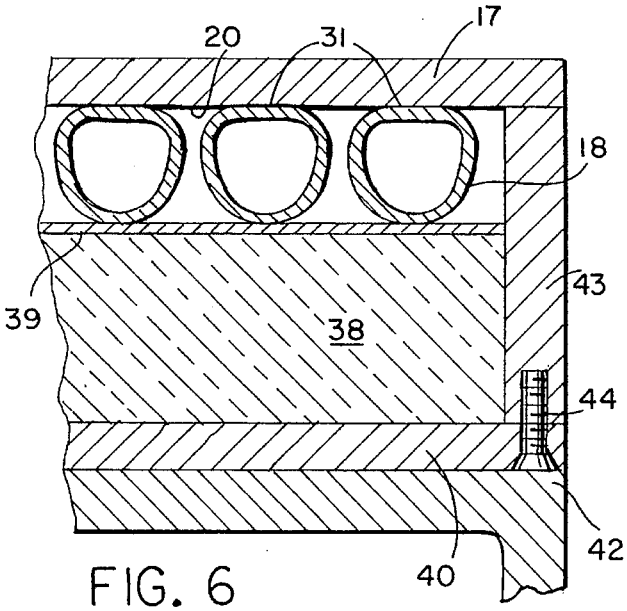
FIG. 6
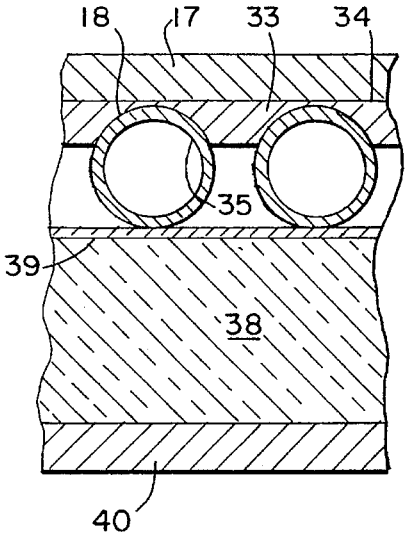
FIG. 7

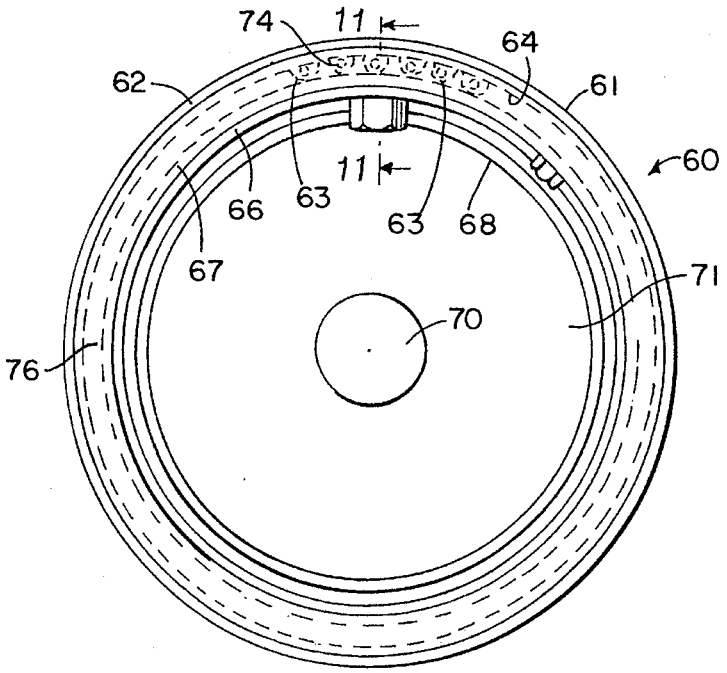
FIG. 10
FIG. 11
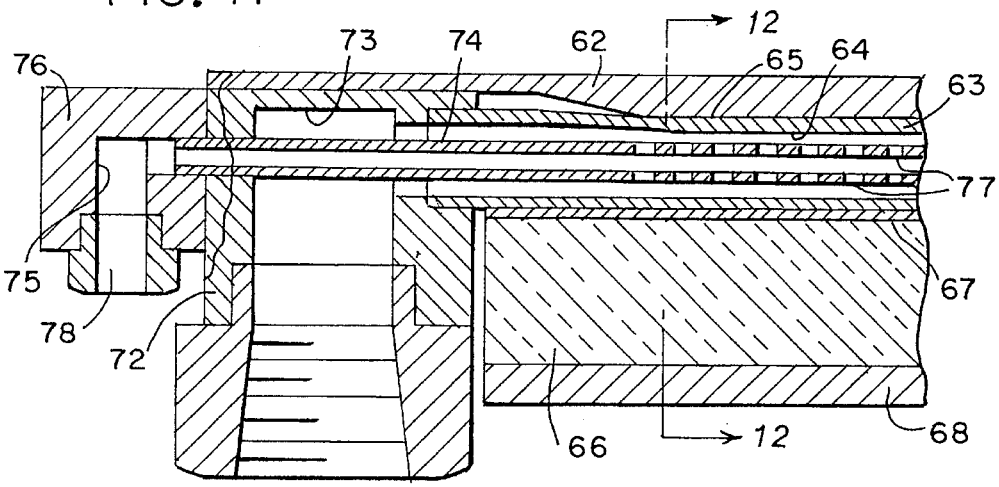
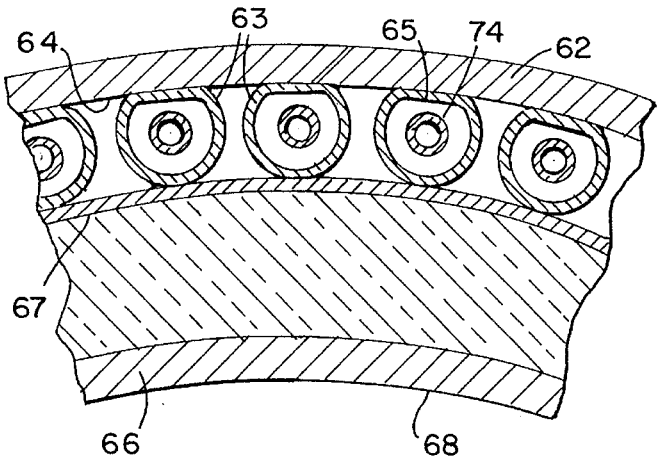
FIG. 12

HEATING DEVICE FOR CORRUGATED PAPERBOARD PRODUCTION

This is a continuation-in-part of application Ser. No. 08/255,159, filed Jun. 7, 1994, entitled Hot Plate for Corrugated Paperboard Double Facer.

BACKGROUND OF THE INVENTION

The present invention relates to an apparatus for the manufacture of corrugated paperboard and, more particularly, to a heating apparatus for a double facer where a liner web is attached to a single face corrugated web and to a preheating device for a liner web or a single face web.

In a typical prior art double facer, a liner web is brought into contact with the glued flute tips of a single face corrugated web and the freshly glued double face web is passed over the surfaces of a number of serially arranged steam chests to cause the starch-based glue to set. Double face web travel over the steam chests is provided by a wide driven holddown belt in direct contact with the upper face of the corrugated web and the top face of the belt held in contact with the traveling web by a series of ballast rollers or the like, all in a well known manner.

Prior art steam chests, one example of which is shown in U.S. Pat. No. 3,175,300, are typically made of heavy cast iron construction in the manner of a pressure vessel in order to contain the high pressure steam which is supplied to the steam chest. For example, the walls of a cast iron steam chest are typically 1" or more thick to safely contain saturated steam supplied, for example, at 365° F. and 165 psi (185° C. and 1138 kPa). A steam chest has a flat upper web-supporting surface having a length in a transverse direction sufficient to support the full width of the traveling web and a width in the direction of web movement of typically about 18 inches to 24 inches (46 cm to 61 cm). Ten to twenty steam chests are typically serially arranged in closely spaced relation in a double facer.

The heavy cast iron construction of prior art steam chests results in a number of well known operational problems. The heavy walled construction of these steam chests requires a long time to bring them up to temperature on startup. Eventually, the steam chest may be brought close to the temperature of the steam being supplied to it. However, when operation is commenced and the double face corrugated web is traveling over the upper surfaces of the steam chests, heat is drawn therefrom at a rapid rate and surface temperature may drop to levels as low as 220°–230° F. This lower effective operating temperature may require the use of a substantially larger number of steam chests in a given double facer than would be necessary if more efficient heat transfer were attainable. The operating speed may also have to be reduced in order that the corrugated board may be properly cured. Another problem directly related to the inefficiency of heat transfer through a heavy iron steam chest casting is the transverse bowing of the upper surface of a conventional steam chest during operation. As indicated, the temperature of the flat upper wall of the steam chest is reduced substantially relative to the bottom wall of the steam chest resulting in a concave bowing of the upper surface lengthwise of the steam chest (transversely across the web traveling thereover). As a result, the holddown belt and transverse ballast rollers pushing the belt downwardly against the upper surface of the web do not impose a uniform load on the web. The result may be uneven curing of the adhesive, zones of poor or no adhesion, and crushing of the lateral edges of the web. Finally, the heavy mass of cast iron steam chests results in high heat retention and slow cool down, often requiring elaborate systems to lift the web or lower the steam chests to avoid excess heating of the web.

U.S. Pat. No. 5,183,525 includes a recognition of certain of the foregoing operational problems in systems utilizing heavy cast iron steam chests. In this patent, the steam chest is replaced by a heavy steel plate through which transverse horizontal bores are drilled and interconnected at their opposite lateral ends to form a serpentine steam passage through the plate. The holes may be drilled in a manner forming a much thinner web of material between the bores and the upper surface of the plate to increase the efficiency of heat transfer. The patent also teaches that the problem of bowing or distortion of the upper contacting face of the plate is minimized. However, the construction of the heating plates in this patent is still quite massive and heavy and, as is well known, the heat transfer efficiency of ferrous metals is relatively poor.

There remains a need, therefore, for a simple, efficient, and low cost hot plate system for a double facer which effectively addresses the problems typical of the prior art.

The web components of a double face corrugated web are also typically heated in the various stages of production of the corrugated board. The liner web and the medium web are typically preheated prior to their being joined together in the single facer apparatus. Similarly, the resultant single face web is also preheated prior to its being glued to the other liner web in the double facer. Preheating of the component webs is conventionally accomplished by causing the web to be wrapped around a portion of the circumference of a rotary preheating drum, the interior of which is heated with steam. Preheater drums are typically made of heavy walled cylindrical steel shells which, like conventional heavy walled steam chests described above, are slow to heat and slow to cool. Thus, variations in the amount of heat transferred to a web passing around the preheater drum is controlled with orbital wrap arms which can vary the amount of wrap which is applied to the web around the drum surface.

A description of conventional rotary drum preheaters and preheater control is contained in U.S. Pat. No. 3,981,758. In the manufacture of corrugated paperboard, however, board quality is typically best maintained if process variables, such as wrap arm adjustment on the preheaters, are minimized. Nevertheless, the amount of heat which is applied to the web components by the various preheaters must occasionally be varied and, because of the slow response time in heating or cooling the heavy metal preheater drum shells, wrap arm adjustment is the only practical means available to vary the amount of component web heating.

Therefore, it would also be desirable to improve the heating and cooling capabilities of prior art web preheaters, both to improve heat transfer response and to minimize the need for preheater wrap arm adjustments.

SUMMARY OF THE INVENTION

In accordance with one aspect of the present invention, a heating device for a traveling paper web includes a thin outer metal plate which has a smooth web-supporting outer surface. A series of spaced generally parallel open ended heating tubes are positioned in operative heat-conducting contact with the inner surface of the outer metal plate. A pair of heating manifolds are provided, each one connecting the open ends of the tubes along one of the opposite edges of the outer plate; and, a source of heated fluid is operatively connected to the heating manifolds to transfer the fluid from one of the manifolds, through the heating tubes to the other manifold.

In one embodiment, the outer metal plate is cylindrical in shape and is mounted for rotation on the axis thereof to provide a rotary web preheater drum. Each of the manifolds comprises an annular ring having a diameter substantially the same as the cylindrical outer plate. The heated fluid preferably comprises steam and this embodiment may further comprise a series of cooling water supply tubes of smaller diameter than the heating tubes and which are mounted generally coaxially therein. The cooling water supply tubes have perforated walls which provide open communication from the interiors thereof to the interiors of the respective heating tubes. A cooling water supply manifold is mounted along one edge of the outer plate adjacent one of the heating manifolds and is connected to the open ends of the water supply tubes at that edge of the outer plate. A pressurized source of cooling water is operatively connected to the cooling water supply manifold.

In accordance with a further aspect of the present invention, a hot plate for supporting and heating the moving web of corrugated paperboard in a double facer includes a web supporting top plate made of a metal, such as copper, having a high heat transfer efficiency (high thermal conductivity), a series of spaced generally parallel tubes extending below the plate transversely to the direction of web travel and positioned in a planar array in operative heat conducting contact with the underside of the top plate, a pair of manifolds each connecting the open ends of the tubes along one lateral edge of the top plate, a source of a heated fluid operatively connected to the manifolds, and means for transferring the heated fluid through the tubes between the manifolds. The apparatus also includes a lower supporting frame which has a bottom plate that underlies the top plate in parallel vertical spaced relation, anchoring means that rigidly interconnect the top plate and the bottom plate in the cross machine direction midway between the manifolds, and vertical hold-down means which interconnect the manifolds to the lateral outer edges of the supporting frame in a manner which prevents vertical movement of the lateral edges of the top plate, but allows horizontal lateral movement thereof as a result of thermal expansion.

In a preferred construction, a layer of insulation is placed between the bottom plate and the tubes which underlie the top plate. Preferably, a thin metal sheet is interposed between and in contact with the insulating layer and the tube array.

The entire heat transfer portion of the hot plate of the present invention, including the top plate, the tubes, and the manifolds, is preferably constructed of copper. Brazed connections are provided between the tube ends and the manifolds and the heating fluid is high pressure steam.

The steam carrying tubes are, at least initially, circular in cross section, but are provided with a flat operative heat conducting contact surface between each tube and the overlying top plate. The flat contact surface preferably comprises a flattened surface segment along the tube between the manifolds. Alternately, the flat contact surface may comprise a spacer plate which has a flat upper surface in contact with the underside of the top plate and a corrugated lower surface which conforms to the cross sectional shape of the array of tubes.

The upper surface of the copper top plate which supports the web is clad with a wear resistant material, preferably hard chrome plating, or may have a replaceable wear plate.

BRIEF DESCRIPTION OF THE DRAWINGS

FIG. 3 is a side elevation of the hot plate shown in FIG. 2.

FIG. 4 is a sectional detail taken on line 4—4 of FIG. 3.

FIG. 5 is an enlarged sectional detail of a portion of FIG. 3.

FIG. 6 is a sectional detail taken on line 6—6 of FIG. 2.

FIG. 7 is a sectional detail similar to FIG. 6 showing an alternate construction.

FIG. 10 is an end elevation view of a web preheater drum to which the heating device of the present invention has been applied.

FIG. 11 is an enlarged partial section taken on line 11—11 of FIG. 10 and showing further details of this embodiment.

FIG. 12 is a partial sectional view taken on line 12—12 of FIG. 11.

DETAILED DESCRIPTION OF THE PREFERRED EMBODIMENTS

Figure 1:
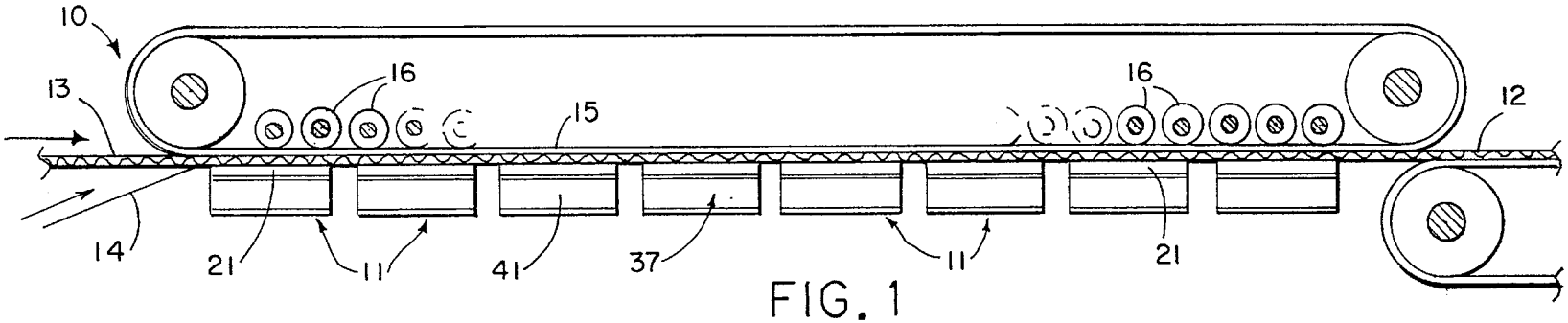
FIG. 1 is a generally schematic side elevation of a double backer utilizing the hot plates of the subject invention.

Referring first to FIG. 1, a double facer 10 of conventional construction is shown schematically and includes a series of hot plates 11 constructed in accordance with the subject invention. Each of the hot plates 11 is identically constructed and performs the same heating function in the manufacture of a double face corrugated web 12 as is provided by prior art steam chests, described above. Thus, the hot plates 11 provide a flat, substantially continuous heated surface over which the double face web (formed by joining a single face corrugated web 13 and a liner web 14) is conveyed by a holddown belt 15 which is pressed down against the web 12 by a series of ballast rollers 16.

Figure 2:
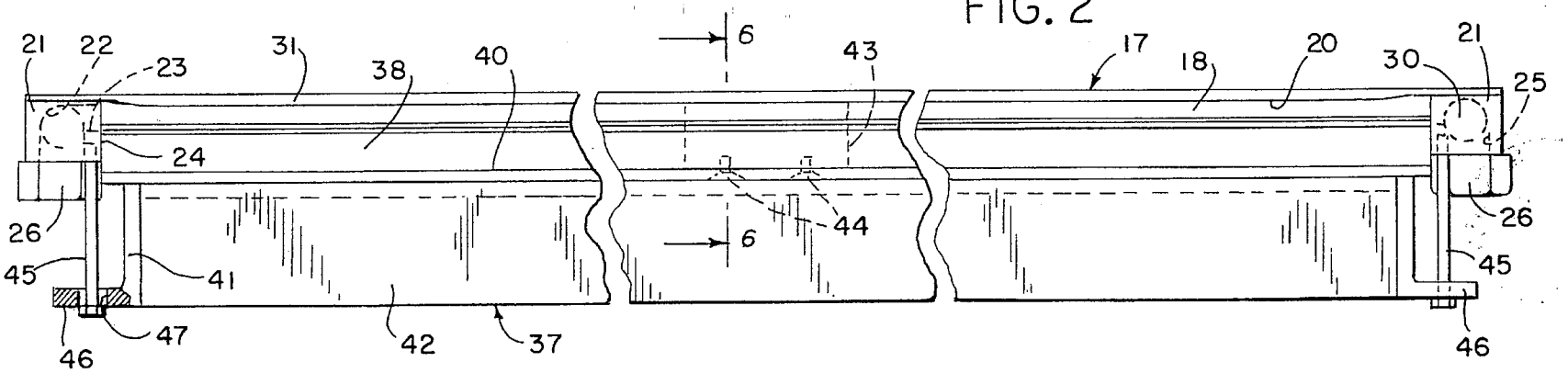
FIG. 2 is an end elevation, partly in section, of a hot plate of the subject invention.

Referring also to FIGS. 2 and 3, each of the hot plates 11 includes a top plate 17 preferably made of a metal having a thermal conductivity substantially higher than that provided by ferrous metals. Preferably, the top plate 17 is made of copper and may be ¼" (6.4 mm) thick. The higher thermal conductivity and substantially thinner section both contribute to the ability to transfer heat more efficiently from the inside of the hot plate 11 to the outer surface in contact with the moving double face web 12. However, because one aspect of the invention is directed to eliminating the heavy-walled steam chests of the prior art, many of the benefits of the present invention are attainable as well with the use of steel or other metals not having as good thermal conductivity as copper. A substitute top plate of steel might allow a reduction in thickness, for example to ⅛" (3.2 mm), to help offset the poorer thermal conductivity as compared to copper.

A series of spaced generally parallel open-ended copper tubes 18 are positioned in a generally planar array beneath and in operative heat conducting contact with the underside 20 of the top plate 17. The array of tubes conforms generally to the rectangular shape of the top plate 17 which typically has a length in the direction transverse to web movement just slightly greater than the width of the web and a top plate width in the direction of web movement which is substantially shorter, typically about 18" to 24" (46–61 cm). Thus, to accommodate a web 12 of maximum width typically handled in a double facer 10, the hot plate 11 may have a length (in the cross machine direction) in excess of 8 feet (2.6 m). As with the top plate, the tubes may also be made of steel or some other suitable metal.

The opposite ends of the tubes 18 and the lateral edges of the top plate 17 extend between and are attached to a pair of manifolds 21. Each of the manifolds 21 has a length equal to the width of the top plate 17 and has a generally square cross section. Each of the manifolds is preferably machined from a solid copper bar, although copper extrusions may also be utilized. Each manifold is provided with a longitudinal through bore 22 which, as indicated, may be drilled in solid bar stock or formed in the bar as part of an extrusion in process. A series of aligned cross bores 23 are formed in the inside face 24 of each manifold and are sized to receive the ends 32 of the copper tubes 18 therein. The cross bores 23 extend into open communication with the manifold through bore 22 and the joints are brazed to provide a high temperature fitting, such as with silver brazing material. A steam supply or condensate drain opening 25 is provided centrally in the lower face of each manifold 21. The opening 25 extends into the manifold through bore 22 and may be tapped to receive the threaded sleeve 27 of an adaptor union 26. The lower interior end of the union 26 is provided with a conventional pipe thread adapted to receive the threaded end of a steam supply pipe (not shown). The opening 25 in the other manifold would be connected to a condensate return line (also not shown). Steam supplied to the manifold 21 is distributed along the through bore 22 into and through each of the tubes 18 to the manifold on the opposite side of the hot plate. As shown in FIG. 5, the ends of the through bore 22 are sealed with appropriate plugs 30.

Figure 8:
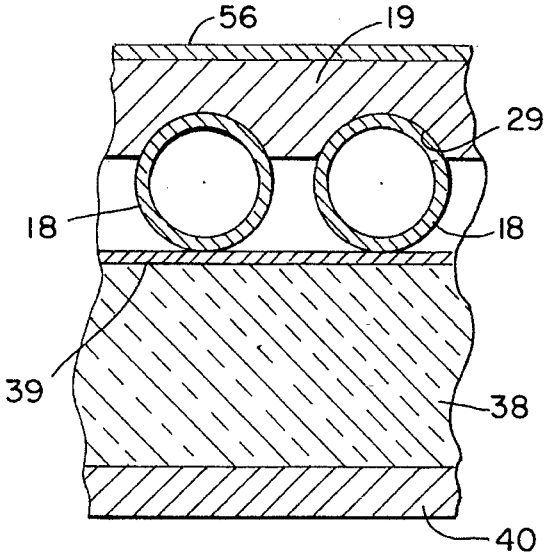
FIG. 8 is a detail similar to FIG. 7 showing other embodiments.

Referring also to FIGS. 6 and 7, to enhance heat transfer from the copper tubes 18 to the copper top plate 17, the upper surfaces of the tubes 18 are provided with flattened segments 31 which extend nearly the full lengths of the tubes and provide enhanced surface contact between the tubes and the underside 20 of the top plate. The brazed tube ends 32 (FIG. 5) remain circular in cross section. Alternately, the enhanced surface contact between the tubes and the top plate may be provided by a specially shaped spacer plate 33 which has a flat upper surface 34 in flush contact with the underside 20 of the top plate and a corrugated lower surface 35 which conforms to and intimately contacts the outside upper surfaces of the tubes. To assist in maintaining the positions of the tubes relative to the top plate and to add strength and rigidity to the overall structure, the flattened surface segments 31 are preferably coated with a solder paste prior to placement of the top plate over the tubes and the subassembly is then baked and cooled to set the solder. Similarly, baked solder paste interfaces could be provided between the spacer plate 33 and the top plate and tubes, respectively. The lateral edges of the top plate 17 are secured to the respective manifolds 21 with a series of machine screws 37 (FIG. 4). Alternately, as shown in FIG. 8, a modified top plate 19 of somewhat greater thickness could be used and the underside machined to form semicylindrical grooves 29 to conform to the outside surfaces of the tubes.

Figure 9:
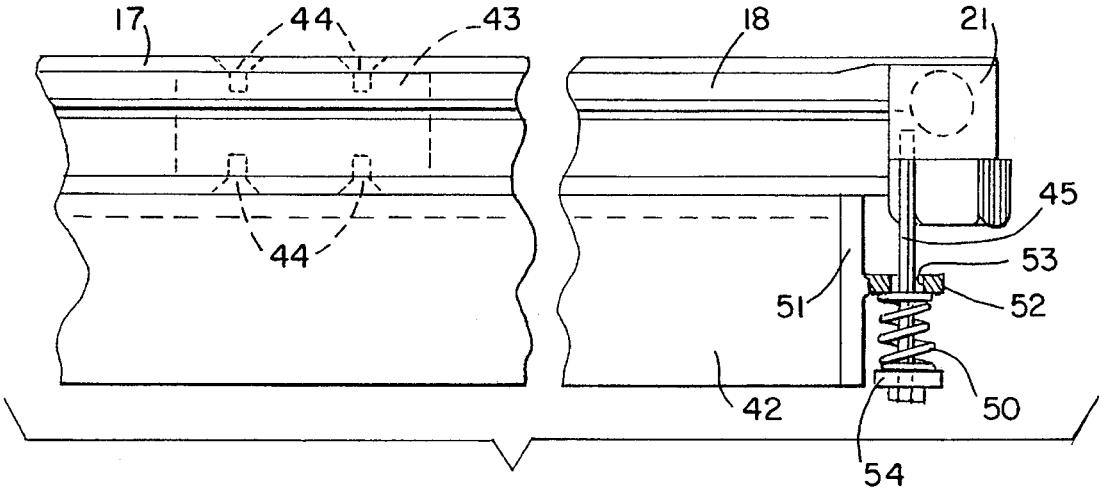
FIG. 9 is a partial end elevation of a modified embodiment of the hot plate.

The entire hot plate subassembly comprising the top plate 17, tubes 18 and manifolds 21, is mounted on a lower supporting frame 37 in a manner to permit unrestricted lateral thermal expansion, but to restrict vertical upward bowing of the lateral edges, as described above. First of all, the underside of the steam carrying tubes 18 is insulated from the lower supporting frame 37 by an insulating layer 38 which is preferably separated from direct contact with the tubes by a thin copper sheet 39 of, for example, 0.030 (0.76 mm) inch thickness. The insulating layer 38 rests on a flat metal bottom plate 40 which also defines the upper surface of the supporting frame 37. The bottom plate 40 may, for example, comprise a ¼ inch (6.4 mm) rectangular steel plate of approximately the same area as the underside of the hot plate. The bottom plate 40, in turn, rests on a box-like frame constructed from a pair of L-shaped side angle members 41 interconnected by a pair of inverted L-shaped cross members 42. The L-shaped angle members 41 and cross members 42 may be suitably connected with welds or any other convenient mechanism and the bottom plate 40 is similarly secured to the upper edges or faces of said members. Referring particularly to FIGS. 2 and 6, the copper top plate 17 is fastened to the bottom plate 40 midway between the manifolds with a pair of anchor plates 43 located at the respective forward and rearward edges of the hot plate. Each anchor plate 43 is secured at its lower edge to the upper face of the bottom plate 40 by a pair of machine screws 44 and the top edge of the anchor plate is soldered to the underside 20 of the top plate 17. In an alternate construction shown in FIG. 9, the top edges of the anchor plates 43 could also be connected to the top plate 17 with machine screws 44.

To prevent the lateral edges of the hot plate 11 from bowing upwardly in use as a result of differential thermal expansions, both edges of the hot plate are secured to the horizontal flange 46 of the L-shaped side members 41 by a series of tie bolts 45 threaded into the lower surface of the manifold 21. As is shown in FIG. 2, the bolt holes 47 in the horizontal flange 46 are elongated in the lateral or cross machine direction to accommodate lateral thermal elongation of the hot plate 11 while holding the top plate edges from upward bowing. In an alternate embodiment (FIG. 9), a modified side member 51 is a T-section having a horizontal flange 52 provided with enlarged bolt holes 53 for the tie bolts 45. A bias spring 50 is captured between each tie bolt head and the underside of the horizontal flange 52. The ends of the bias spring 50 preferably bear against suitable washers 54. The bias springs prevent bowing of the plate edges while the enlarged holes 53 permit limited tilting of the tie bolts to accommodate lateral thermal expansion.

The use of an essentially all copper construction in the fabrication of hot plates 11 of the present invention provides a number of distinct advantages. First of all, the high heat conductivity and heat transfer efficiency allows the hot plates to be brought to operating temperature more quickly on startup, to keep the board contacting upper surfaces at a substantially higher temperature during operation than prior art ferrous metal steam chests, and allows the hot plates to cool down more rapidly when the supply of steam is shutoff. The hot plate support system allows unrestricted lateral thermal expansion of the hot plate, but prevents adverse upward bowing of the lateral edges, resulting in a paperboard web supporting surface which can be maintained more nearly horizontal across the full width of the double facer. The high heat transfer efficiency provided by the hot plates 11 of this invention may allow the use of fewer hot plates than prior art double facers with iron or steel steam chests.

To minimize wear of the board supporting top surface of the hot plates 11, the top Surfaces of the top plates 17 are provided with a wear resistant material. Preferably, the wear resistant surface material is a hard chrome plating. A glass-like or ceramic surface might also be used. Alternately and as shown in FIG. 8, a thin replaceable wear surface 56 could be used. The wear surface 56 may be attached by, for example, snapping it over the forward and trailing edges of the top plate (in the machine direction). To maintain good heat transfer, a thermally conductive paste layer would be placed between the top plate and the wear surface 56. The paste could, for example, comprise an anti-seize compound including a copper filler, allowing the wear surface to be easily removed for replacement and providing good heat transfer.

Referring now to FIGS. 10–12, the heating device of the present invention is shown as applied to a preheater 60 for one of the component paper webs in a corrugator. The preheaters are located upstream of the double facer 10 and may be utilized to preheat the single face web 13 prior to the application of glue to the flute tips of the corrugated medium, or to preheat the liner web 14 prior to entry into the double facer hot plates. Similarly, the liner web component and the medium web component of the single face web 13 may be subjected to preheating in the upstream single facer.

The preheater 60 is in the shape of a cylindrical drum 61, including a thin outer metal plate 62 which may be made of a thin copper sheet similar to that used for the top plate 17 of the previously described hot plates 11. Immediately inside the cylindrical outer copper plate 62 are a series of parallel open-ended copper heating tubes 63 which are positioned in operative heat-conducting contact with the inner surface 64 of the outer plate. Any of the various means used to enhance heat transfer between the tubes 63 and the outer plate 62, described with respect to the hot plate embodiment and shown in FIGS. 6, 7 and 8, may be utilized as well in the cylindrical embodiment for the preheater 60. Thus, for example, each of the heating tubes 63 may be provided with flattened segments 65 positioned in direct contact with the inner surface 64 of the outer plate 62. An inner cylindrical insulating layer 66 is also provided and is preferably separated from the heating tubes 63 by a thin copper sheet 67, as best seen in FIGS. 11 and 12. A radially inner cylindrical support plate 68 provides the support for the assembly thus far described and also provides the means for attachment of the drum to a center hub 70, such as via a pair of circular end plates 71.

Steam is supplied to the preheater via an annular ring-like heating manifold 72 and a similar annular manifold is positioned on the opposite end of the drum 61 to receive the flow of steam or condensate flowing through the heating tubes 63. Each manifold 72 includes an open annular interior chamber to which steam is supplied (or condensate drained). The supply of steam or the removal of condensate requires accommodation of the rotary mounting of the drum and may, for example, include appropriate connections via rotary unions (not shown) at opposite ends of the hub 70.

As shown in FIG. 11, the present invention also includes means to enhance rapid cooling of the heating device, shown applied particularly to the cylindrical preheater 60. However, the apparatus to be described may also be applied as well to the hot plates 11 of the previously described embodiment. Each of the heating tubes 63 has mounted coaxially therein a cooling water supply tube 74. The water supply tubes 74 are of substantially smaller diameter than the internal diameter of the heating tubes 63, so that adequate space for the supply of steam from the heating manifold 72 is retained. The cooling water supply tubes 74 are sealed or closed at one end (not shown) and the opposite open ends extend through the interior chamber 73 of one of the heating manifolds 72 and open into the supply chamber 75 of a cooling water manifold 76. The cooling water manifold may be conveniently attached to the end face of the heating manifold, as shown. The lengths of the cooling water tubes 74 which lie within the interiors of the heating tubes 63 are perforated to provide an array of small cooling water ports 77.

In operation, when it is desired to rapidly discontinue the supply of heat to a component web, the supply of steam to the preheater 60 is discontinued and cooling water is supplied under pressure to the cooling water manifold 76, from which it flows into the water supply tubes 74, through the ports 77 and into the heating tubes 63. Because of the high retained heat of the system, the cooling water will initially flash to steam, but thereafter rapidly condense in the heating tubes 63. The continuing flow of cooling water will result in rapid cooling of the cylindrical outer metal plate 62 over a portion of which the component paper web is moving. The rapid reduction in preheater temperature obviates the need for large excursions in wrap arm adjustment and the corresponding need to compensate for resulting web length changes.

Various modes of carrying out the present invention are contemplated as being within the scope of the following claims particularly pointing out and distinctly claiming the subject matter which is regarded as the invention.

We claim:

1. A heating device for a traveling paper web comprising:

a thin outer metal plate having a smooth web-supporting outer surface;

a series of spaced generally parallel open-ended heating tubes positioned in operative heat-conducting contact with an inner surface of said outer plate;

a pair of heating fluid supply manifolds each connecting the open ends of the tubes along one of a pair of opposite edges of said outer plate;

a source of steam operatively connected to said heating fluid supply manifolds for transfer of the steam through said tubes between the manifolds;

a series of cooling water supply tubes of a diameter smaller than said heating tubes, said water supply tubes mounted generally coaxially within said heating tubes;

said cooling water supply tubes having an open end and perforated walls providing open communication from each of the supply tube interior to the interiors of the respective heating tubes;

a cooling water supply manifold mounted along one edge of the outer metal plate adjacent one of said heating manifolds and connecting the open ends of the water supply tubes at said one edge; and, a pressurized source of cooling water operatively connected to said cooling water supply manifold.

2. The apparatus as set forth in claim 1 wherein said outer metal plate is cylindrical and is mounted for rotation on the axis of the cylinder to provide a web preheater drum.

3. The apparatus as set forth in claim 2 wherein each of said manifolds comprises an annular ring having a diameter substantially the same as said cylindrical outer metal plate.

* * * * *